United States Patent [19]

Wiebe

[11] 4,077,496

[45] Mar. 7, 1978

[54] RAILWAY TRUCK MOVEMENT DAMPING

[75] Inventor: Donald Wiebe, Sewickley, Pa.

[73] Assignee: A. Stucki Company, Pittsburgh, Pa.

[21] Appl. No.: 695,803

[22] Filed: Jun. 14, 1976

Related U.S. Application Data

[62] Division of Ser. No. 538,735, Jan. 6, 1975, abandoned.

[51] Int. Cl.[2] ..... B61F 5/06; B61F 5/12; B61F 5/24; B61F 11/00

[52] U.S. Cl. ..... 188/33; 105/197 DH; 188/288; 267/9 A; 267/9 C; 267/127

[58] Field of Search ..... 105/164, 197 D, 197 DB, 105/197 DP, 197 DH, 199 R, 199 A; 188/288, 289, 321, 33; 267/2, 4, 127, 3, 9 A, 9 C

[56] References Cited

U.S. PATENT DOCUMENTS

| | | | |
|---|---|---|---|
| 1,595,330 | 8/1926 | Woodward | 188/289 X |
| 1,833,940 | 12/1931 | Gibbs | 188/289 |
| 2,363,867 | 11/1944 | Isely | 188/289 |
| 2,520,944 | 9/1950 | Lynn et al. | 105/164 X |
| 2,895,735 | 7/1959 | Bartlett | 188/289 X |
| 3,439,631 | 4/1969 | Cope | 105/164 X |
| 3,595,350 | 7/1971 | Wiebe | 188/321 |
| 3,626,864 | 12/1971 | Wiebe | 105/197 DH |
| 3,722,920 | 3/1973 | Reese | 188/288 X |
| 3,726,368 | 4/1973 | Taylor | 188/289 X |
| 3,837,292 | 9/1974 | Wiebe | 105/197 DH |
| 3,868,912 | 4/1975 | Wagner et al. | 188/321 X |
| 3,995,720 | 12/1976 | Wiebe | 188/33 |

*Primary Examiner*—Johnny D. Cherry
*Assistant Examiner*—Howard Beltran
*Attorney, Agent, or Firm*—Howard E. Sandler

[57] ABSTRACT

A hydraulic snubber device and method of damping for railway trucks and more particularly a snubber adapted to be interposed between a bolster and a side frame member and being operative to provide a first damping rate when the railway car is operating on tangent track or at equilibrium speed on super elevated track and to provide a second relatively higher damping rate when the railway car is operating on super elevated track at low speed and in all instances of severe rocking.

6 Claims, 5 Drawing Figures

RAILWAY TRUCK MOVEMENT DAMPING

This is a division, of application Ser. No. 538,735, filed Jan. 6, 1975, now abandoned.

As is known, in the normal travel of railway cars over a rail bed, various differences in the vertical profile of the laterally spaced tracks resulting from such causes as staggered rail joints and super elevation of the outside track on curves gives rise to a tendency of lateral tilting or swaying of the car body. In modern cars with heavy load capacity and a relatively high center of gravity the energy involved in the swaying can be a significant part of the total energy available in the drawbar force from a locomotive while the forces resulting from the weight shift of the car becomes so large at times that a variety of effects may develop such as:

1. Complete unloading of the wheels on one side of the truck to the extent of lifting the unloaded wheels off the rail with a high potential of derailment;
2. The imposition of extreme stresses on the car body and truck members; and
3. Cumulative damage and misalignment of track, ties and road beds through pounding action.

Various means have been developed to alleviate the above mentioned problems of swaying including the hydraulic snubbing devices described in U.S. Pat. Nos. 3,837,292 and 3,626,864 which are assigned to the assignee as is this application. Such patents illustrate hydraulic snubbers which have proved adequate to dampen the forces which give rise to excessive tendency of lateral tilting or swaying of the car body. However, in such prior art devices the snubbers generally provide a substantially continuous or linear dampening rate independent of whether or not the railway cars are operating on tangent or super elevated (i.e. 6 inches super elevation) track. The inability of such snubbers to provide a variable dampening rate has proved to be somewhat inadequate in all instances for experience has shown that a low damping rate is advantageous when the car is operating on tangent track or at equilibrium speed on curved super elevated track and a high damping rate is advantageous when the car is operating on super elevated track at less than equilibrium speed. When running on tangent track the tendency of tilting or swaying of the car body is minimal and hence a relatively soft dampening rate, for example 25 to 70 kip-seconds per foot, is desirable to ensure smooth ride and minimal rebound. On the other hand, when running on super elevated track at less than equilibrium speed for the particular superelevation and curvature the tendency of tilting or swaying of the car body is at a maximum and hence a relatively high dampening rate, for example 100 to 200 kip-seconds per foot, is desirable to ensure maximum energy dissipation.

This recognition of a necessity for a variable dampening rate has been somewhat illustrated in U.S. Pat. No. 3,626,864; however, such patent merely anticipates a continuously variable dampening rate uniformly changing from a low to a high. The structure illustrated in the patent would provide a high dampening rate on only one side of a truck riding on super elevated track and on the other side of such truck the dampening rate of the snubber would be quite low.

By means of the present invention which provides an arrangement wherein a relatively constant low damping rate is present on both sides of the truck during travel on tangent track and a relatively high constant damping rate is present on both sides of the truck during travel on a super elevated track, the hereinabove mentioned problems of snubbers having a single dampening rate or only a continuously variable dampening rate are overcome.

These and other objects and advantages of the present invention will become more readily apparent from a reading of the following description and drawings in which.

Figure 1:
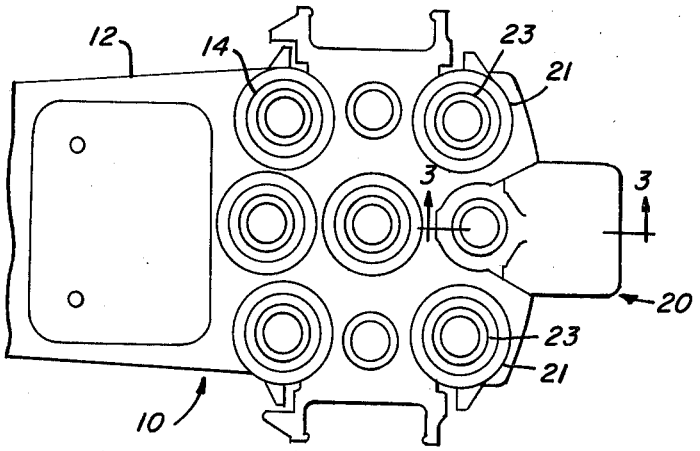
FIG. 1 is a top plan schematic view of a portion of a freight car truck particularly of a spring group incorporating a snubber constructed in accordance with the principles of the present invention.
Figure 2:
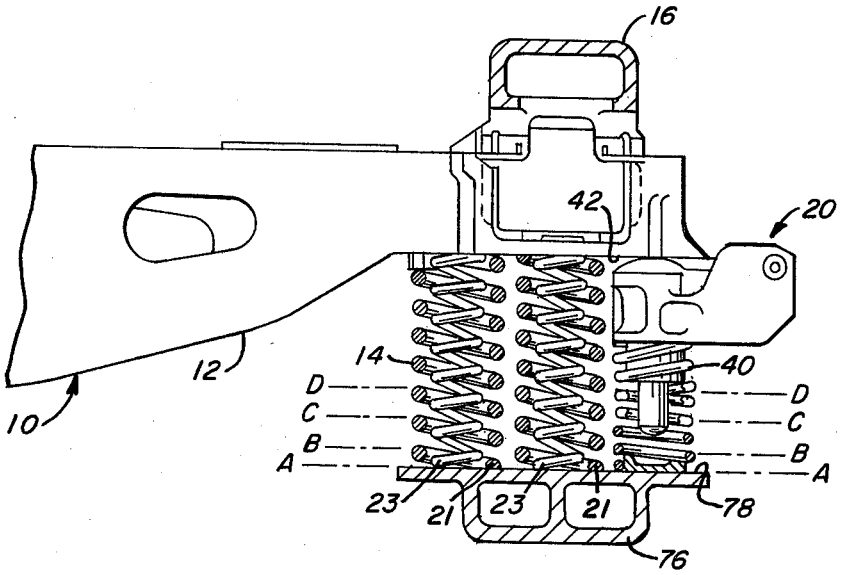
FIG. 2 is a fragmentary partially sectional schematic view of the truck illustrated in FIG. 1.

FIGS. 1 and 2 illustrate a fragmentary portion of a four wheel railway freight car, generally illustrated at 10, wherein a center plate and suitable side bearings (not shown) cooperate with a bolster 12 to support the car body (not shown). Spring groups 14 are mounted on side frames 16 (only one being shown) to support the bolster 12. A snubber of the present invention, best illustrated in FIG. 3 and generally represented by 20, is shown as being disposed in the spring group 14.

Inasmuch as the invention herein is primarily directed at snubber 20 and the balance of the elements set forth hereinabove are well known in the art further description of such elements will not be set forth hereinafter except where necessary to describe snubber 20.

Snubber 20 comprises a body member 22 which provides a hollow cylindrical interior surface 24 in which a piston 26 is reciprocated by action of a piston rod member 28 which extends downwardly from the piston 26 through a closure member 30 rigidly secured in the lower open end of the body member 22 as by snap ring 32 and maintained in fluid tight relationship with the body member 22 in any suitable manner, such as O-rings 34.

The top end of the body member 22 is permanently closed by a top member 36 suitably secured to a stepped portion of the body member 22 such as by welding. The top member 36 is shown as having an upwardly convex surface contacting the underside of the bolster end in place of the conventional spring as best seen in FIG. 2. It is to be seen that the snubber 20 replaces any one of the pairs of springs 21 and 23 when in operational position.

The lowermost end of piston rod 28 includes a downwardly convex surface adapted to be received in a mounting ring 38 secured or trapped in place between a body support spring 40 and the lower surface 42 of an adjacent end portion of bolster 12. The body support spring 40 surrounds a reduced diameter outside surface portion of body member 22 and is interposed between an annular shoulder 46 of the body member 22 and the shouldered top surface 48 of the mounting ring 38. As best seen in FIG. 2 in this position the body spring 40 supports the body member 22 in all relative positions of the bolster and side frame and holds the mounting ring 38 in position.

Figure 3:
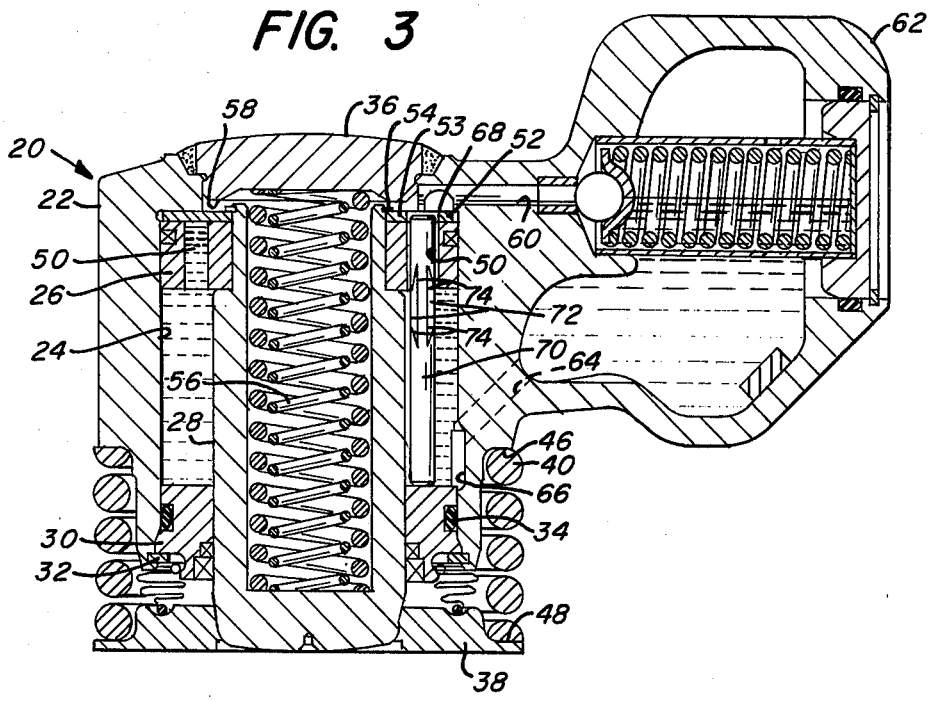
FIG. 3 is a sectional view of a snubber constructed in accordance with the principles of the present invention and taken on lines 3—3 of FIG. 1.

Piston 26 is provided with a ring of vertical through bores 50 having axes parallel to the axis of piston rod 28 and circumferentially spaced about the axis of piston 26 and radially equidistant therefrom. Covering the top ends of the bores 50 is an annular disc valve 52 loosely slidable upon a through piston extension portion of the piston rod 28 and prevented from displacement off this extension portion by means such as a snap ring 54 which nevertheless allows the valve 52 to move far enough away from the bores 50 to allow a flow of hydraulic fluid therethrough. Piston 26 and piston rod 28 are biased downwardly by a coaxial double compression spring assembly 56. The piston 26 is movable upwardly in the body member 22 until the disc valve 52 comes into contact with a shoulder formed by the transition from the full diameter portion of surface 24 (i.e. that portion substantially equal to the diameter of piston 26) to a smaller diameter portion at the upper end of surface 24. The above mentioned portion in conjunction with the upper surface of piston 26 and disc valve 52 defines an upper variable volume chamber 58 which communicates with a passageway 60 extending substantially horizontally to the right as seen in FIG. 3. Passageway 60 is in turn in valved communication with a suitable reservoir 62. The design and working parameters of reservoir 62 are not the subject matter of the present invention and for a more detailed understanding thereof the reader is hereby referred to U.S. Pat. No. 3,837,292. The reservoir 62 additionally communicates with a lower variable volume snubber chamber 66 through a passageway 64 extending from a lower portion of the reservoir 62 through surface 24 adjacent the lowermost end of chamber 66. As illustrated, chamber 66 is generally annular in configuration and is generally defined by surface 24 and the external periphery of piston rod 28 axially intermediate the lower end of piston 26 and the upper end of closure member 30.

Disc valve 52 includes a bore 68 therethrough having a diameter thereof substantially equal to the diameter of bores 50. In assembled position bore 68 is coaxially aligned with a single bore 50 and an elongated valve means or valve rod 70 is coaxially received therethrough. Valve rod 70 has a generally cylindrical configuration, is of a diameter slightly smaller than the diameter of bores 68 and 50 and is received within body member in a manner that the longitudinal axis thereof in generally parallel to the longitudinal axis of piston rod member 28 and the lowermost end of valve rod 70 is seated on an upper portion of closure member 30. Valve rod 70 is of sufficient length that when seated on closure member it extends upwardly therefrom through coaxially aligned bores 50 and 68 and the uppermost end thereof terminates no lower than adjacent the uppermost surface 53 of disc valve 52 when the piston 26 is in the extreme uppermost position within body member 22. Valve rod 70 includes a plurality of outwardly open circumferentially spaced longitudinally extending grooves 72 therein for a purpose as will be fully described hereinafter. Grooves 72 are located intermediate the axial ends of valve rod 70 and include transitional portions 74 adjacent the ends thereof which provide a gradual transition from the outermost periphery of valve rod 70 to the innermost depth of grooves 72.

When the snubber 20 is assembled with the body spring 40 it extends between the side frame bottom member 76 and the bolster bottom surface 42 as seen in FIG. 2. Also, as seen in FIG. 2 the top surface 78 of the side frame bottom member 76 will, when the bolster 12 and side frame 16 are assembled but not supporting a car, be at a level indicated by the line A-A relative to the bolster 12. When a car body is placed on the truck of which this side frame 16 and bolster 12 are a part, the relative position of the top surface 78 of the side frame bottom member 76 will be at a position relative to bolster 12, represented by the horizontal line B-B. This would be the unloaded car position and it is well illustrated that in this position there would be little or no action of the snubber 20 even if the car should bounce somewhat or rock slightly as it is being propelled along the rails. The next horizontal line upward from B—B, namely C—C represents the normal position of the top surface 78, relative to the bolster 12, with the loaded car at static equilibrium on level track or traveling at equilibrium speed on curved track and it is seen that at this time the hitherto fully downwardly extended piston rod will be forced upwardly into the body member 22 by the slight amount represented by the height of the line C—C above the downwardmost position of the piston rod member 28 in FIG. 3. The topmost of the horizontal lines namely D—D, represents the position of the top surface 78 relative to the bolster 12 when the spring group has completely collapsed into solid condition.

Figure 4:
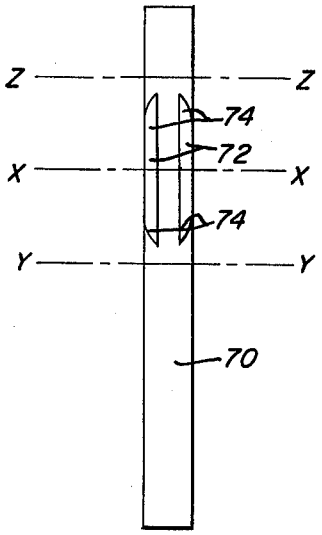
FIG. 4 is a schematic illustration of the relative positioning of the disc valve of the snubber shown in FIG. 3 with respect to the valve means thereof during various operating conditions of a railway truck.

FIG. 4 is a schematic illustration of the positioning of the piston 26 with respect to the relatively stationary valve rod 70 during normal operation of the snubber 20. When the top surface 78, relative to the bolster is at the position generally illustrated at line C—C in FIG. 2 and the railway car is operating in a loaded condition on level track or at equilibrium speed on superelevated track the top surface 53 of disc valve 52 with respect to the valve rod 70 is indicated at line X—X. In this position snubber 20 will be operating at a relatively low damping rate. The low damping rate will continue within a predetermined range of oscillations, for example plus or minus three quarters of an inch. A high damping rate when operating at loaded conditions on level track or at equilibrium speed on superelevated track is not desirable because of excessive rebound and transmissability of forces. Under the same operating conditions as discussed hereinabove with the exception that the loaded railway car is operating at low speed on superelevated track (i.e. 6 inches) and in all instances of severe rocking the relative positions of the surface 53 with respect to the valve rod 30 is illustrated at Y—Y for the high side snubber and at Z—Z for the low side snubber. It is noted that in these latter mentioned positions full flow of hydraulic fluid cannot pass through aligned bores 50 and 68 via grooves 72.

During normal operation of a railway car the limit of extension of the piston rod 28 precludes any action of the snubber 20 with a light car so that true operation of snubber 20 begins with a loaded car being moved along a railway and responding to the variations in track height in a well known manner. With the car standing level, traveling on a level track or traveling at equilibrium speed on superelevated track the normal position of the piston and disc valve 52 is represented by line X—X in FIG. 4. As the car begins to rock a first motion could be the downward motion of the bolster 12 toward the side frame bottom member 76 thereby forcing the piston 26 higher into the body member 22. This action would force liquid from the lower chamber 66 to upper chamber 58 by simultaneously passing through both the grooves 72 and the annular space between the valve rod 70 and the aligned bores 50 and 68. The displaced liquid then passes from upper chamber 58 through horizontal passageway 60 and into the reservoir 62. It is important to note that by utilizing valve rod 70 the additional volume of grooves 72 through which the liquid may be displaced provides a relatively soft dampening rate, for example 25 to 70 kip-seconds per foot is provided in instances when the car is running on tangent track. Such a soft dampening rate is certainly advantageous when tilting or swaying of the car body is minimal, as in instances when the car is traveling on tangent track, thereby better ensuring a smooth ride and minimal rebound.

On the other hand in instances when a loaded railway car is traveling at a low speed on a superelevated track the tendency of tilting or swaying is at a maximum and hence a relatively high dampening rate, for example 100 to 200 kip-seconds per foot, is desirable to ensure maximum energy dissipation. Accordingly, by utilizing valve rod 70 the upper and lower side snubbers 20 will have their respective disc valve 52 positioned as illustrated in FIG. 4 to provide a more restricted flow from lower chamber 66 to upper chamber 58 in instances when the piston is forced upwardly into the body member 22. In such instances the displaced liquid flow between such chambers is restricted to the annular space between valve rod 70 and aligned bores 50 and 68. In instances where the railway car is changing from superelevated to tangent track the transition portions 74 of grooves 72 are provided to aid in a smooth transition from a hard to soft dampening rate and vice versa.

When the bolter 12 begins to rise with relation to the side frame 16 the piston 26 travels downwardly in the body member 22 and is able to do so readily and rapidly because the disc valve 52 will lift off the surface of the piston 26 as soon as the pressure in lower chamber 66 is even slightly greater than the pressure in chamber 58 as the piston 26 travels downwardly. Additional description of the operation of a valve such as disc valve 52 may be found in the aforementioned U.S. Pat. No. 3,837,292.

Figure 5:
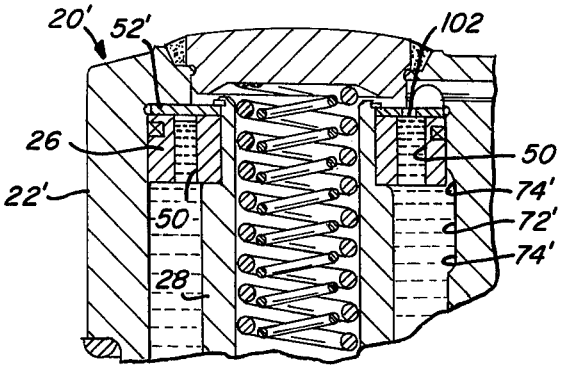
FIG. 5 is a fragmentary sectional view of another snubber constructed in accordance with the principles of the present invention.

The basic concept of the present invention is to provide a snubber wherein a relatively constant low dampening rate is present on both sides of the truck during travel on a tangent track or at equilibrium speed on superelevated track and a relatively high constant dampening rate is present on both sides of the truck during low speed travel on a superelevated track and in all instances of severe rocking. Accordingly, many modifications can be made to the preferred embodiment described hereinabove without departing from the scope of this invention, for example: a plurality of valve rods 70 and corresponding bores 68 may be utilized; and greatly differing snubber configurations can be utilized with the primary common requisite being the utilization of a piston type hydraulic snubber having axially spaced variable volume chambers with the dampening being effected by hydraulic fluid flowing between the chambers. An example of the latter mentioned alternative embodiment is illustrated in FIG. 5 wherein the snubber 20′ high dampening rate flow is primarily through a small bore 102 in disc valve 52′ which is aligned with one of the bores 50 and low dampening rate flow is primarily through small bore 102 and grooves 72′ which are cut in the inner peripheral wall of body member 22′. As can be seen from the drawing the grooves 72′ of snubber 20′ are located intermediate the axial ends of body member 22′ and in substantial alignment with the grooves 72 of snubber 20. Accordingly, the heretofore described operational characteristics of snubber 20 are equally applicable to snubber 20′.

What is claimed is:

1. A method of damping relative movement between railway truck side frame members and a railway truck bolster member, extending transversely between said side frame members, during movement of a loaded railway freight car assembly on a track comprising the steps of: applying substantially equal first hydraulic damping forces to said members adjacent each longitudinal end of said bolster member when said railway car assembly is normally operating on tangent track and when said railway car is operating at equilibrium speed; applying substantially equal second hydraulic damping forces to said members adjacent each longitudinal end of said bolster member when said railway car assembly is operating at low speed on superelevated track and in all instances of severe rocking; and said second hydraulic damping forces being greater than said first hydraulic damping forces.

2. A method as specified in claim 1 wherein said substantially equal second hydraulic damping forces are applied to said members when said railway car is operating at low speed on both the left and the right side of superelevated track.

3. A method as specified in claim 1 including the additional step of applying substantially equal third hydraulic damping forces to said members adjacent each longitudinal end of said bolster member when said railway car is operating at transitional conditions intermediate the operating conditions of said railway car during the application of said first and second hydraulic damping forces.

4. A method as specified in claim 3 with said third hydraulic damping forces being at a force level intermediate said first and second hydraulic damping forces.

5. A method as specified in claim 1 wherein said hydraulic damping forces are applied to said members at locations adjacent spring groups supporting adjacent end of said bolster member on said side frame members of said railway car.

6. A method as specified in claim 1 including the additional step of continuously biasing the means for applying said hydraulic damping forces away from said truck side frame members and towards said truck bolster member.

* * * * *